United States Patent [19]

Williams

[11] Patent Number: 4,568,597

[45] Date of Patent: Feb. 4, 1986

[54] METHOD OF AND AN APPARATUS FOR COATING A SURFACE OF A FIBER BLANKET

[75] Inventor: Ian Williams, Chester, United Kingdom

[73] Assignee: Shell Oil Company, Houston, Tex.

[21] Appl. No.: 523,500

[22] Filed: Aug. 15, 1983

[30] Foreign Application Priority Data

Jan. 25, 1983 [GB] United Kingdom ..... 8301990

[51] Int. Cl.[4] ..... B32B 3/10; B32B 5/06; B32B 5/22; B05D 3/02

[52] U.S. Cl. ..... 428/137; 118/105; 118/120; 118/215; 264/156; 427/230; 427/389.8; 427/389.9; 428/302

[58] Field of Search ..... 427/289, 290, 393.3, 427/389.9, 97, 230, 389.8; 156/252, 253, 305, 148; 264/156, 258, 261, 249, 263; 428/138, 137, 131, 198, 235, 301, 302; 118/105, 120, 215

[56] References Cited

U.S. PATENT DOCUMENTS

| | | | |
|---|---|---|---|
| 1,978,620 | 10/1934 | Brewster | 156/305 |
| 3,814,654 | 6/1974 | Kugel | 156/253 |
| 3,993,523 | 11/1976 | Hunt et al. | 156/148 |
| 4,301,192 | 11/1981 | Plichta et al. | 427/97 |

*Primary Examiner*—Michael R. Lusignan
*Attorney, Agent, or Firm*—Peter A. Bielinski

[57] ABSTRACT

The invention relates to a method of coating a surface of a fiber blanket comprising forcing a plurality of probes through the fiber blanket until the probes extend beyond the surface to be coated, so that holes are formed in the fiber blanket, applying fluid coating material on the surface to be coated, retracting the probes from the fiber blanket, allowing the coating material to flow into the holes during the retraction of the probes, forming heads of the coating material at the uncoated surface of the fiber blanket, and allowing the coating material to harden. The invention relates moreover to an apparatus for carrying out this method. The coated fiber blanket obtained by the method according to the invention has the advantage that the hardened layer of coating material is firmly anchored to the blanket.

4 Claims, 7 Drawing Figures

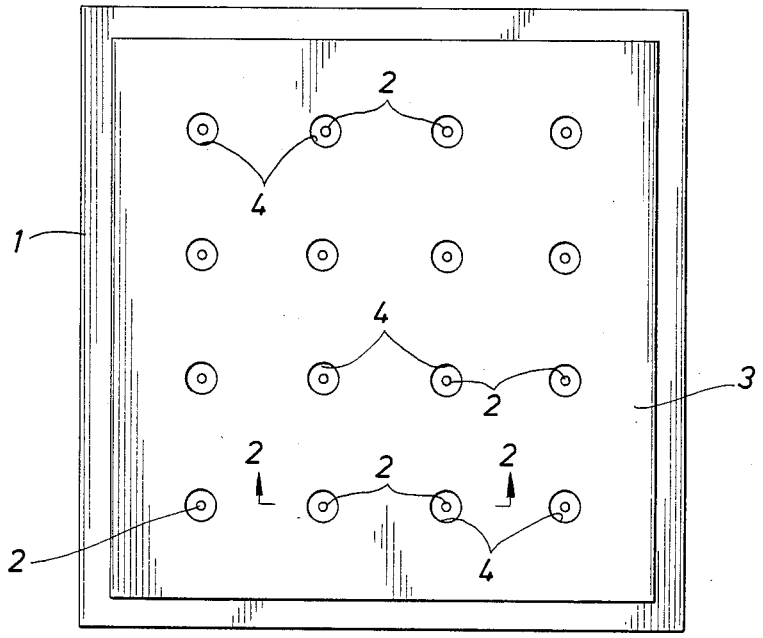
FIG.1
FIG. 2
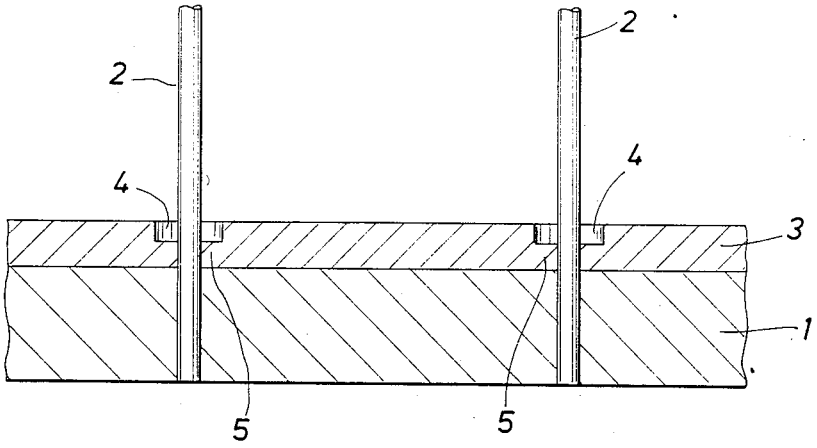

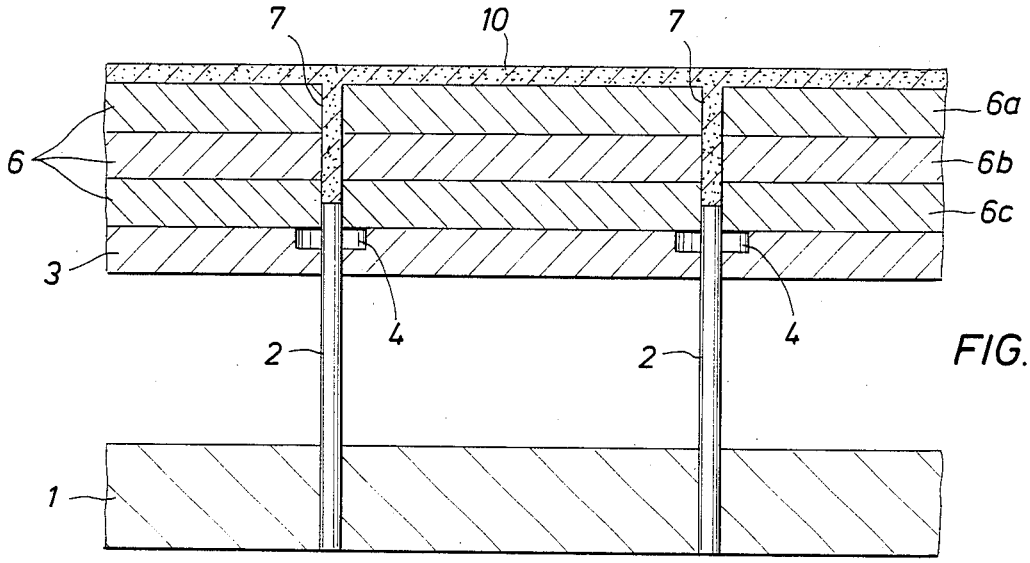
FIG. 3C
FIG. 3D
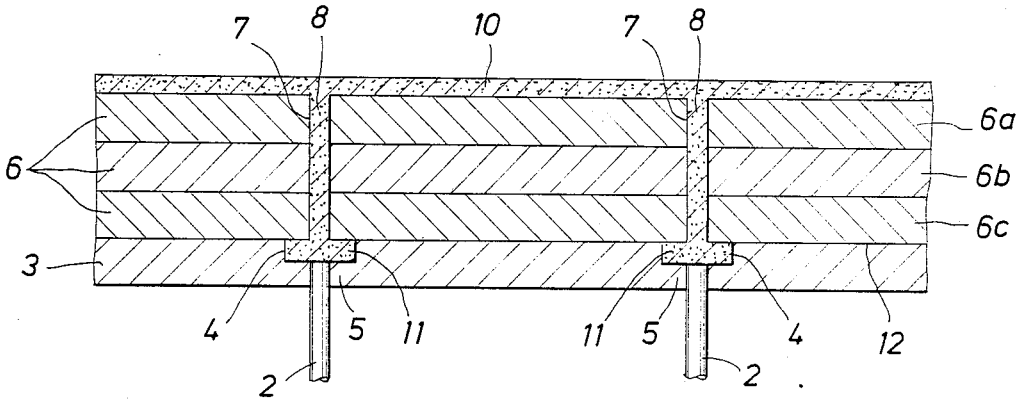
FIG. 4
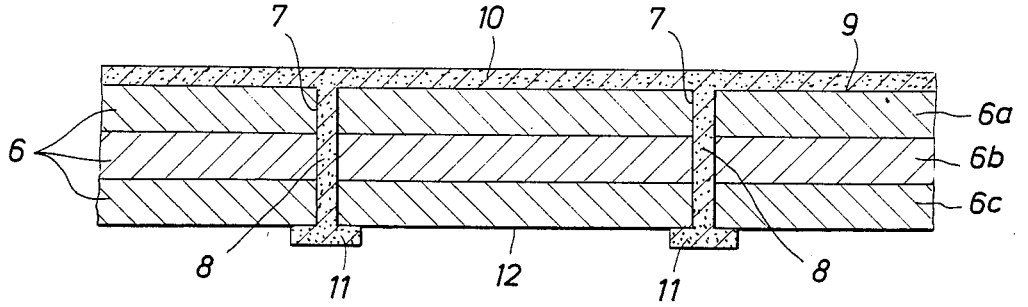

METHOD OF AND AN APPARATUS FOR COATING A SURFACE OF A FIBER BLANKET

FIELD OF THE INVENTION

The invention relates to a method of and an apparatus for coating a surface of a fiber blanket. Such a coated fiber blanket, comprising one or more layers of for instance ceramic fibers which are pressed together, at least one surface of which is coated with for instance an intumescent coating material, is commonly used as a lightweight fireproof material.

BACKGROUND OF THE INVENTION

The conventional method of coating a surface of such a fiber blanket comprises applying coating material on the surface to be coated and allowing the coating material to harden. A disadvantage of a fiber blanket coated according to the conventional method is that the layer of hardened coating material will easily peel from the surface of the fiber blanket when the fiber blanket is deformed.

DESCRIPTION OF THE INVENTION

It is an object of the present invention to provide an improved method of coating a surface of a fiber blanket so that a coated fiber blanket can be produced which does not have the said disadvantage.

For this purpose the method of coating a surface of a fiber blanket comprises according to the invention, forcing a plurality of probes through the fiber blanket until the probes extend beyond the surface to be coated, so that holes are formed in the fiber blanket, applying fluid coating material on the surface to be coated, retracting the probes from the fiber blanket, allowing the coating material to flow into the holes during the retraction of the probes, forming heads of the coating material at the uncoated surface of the fiber blanket, and allowing the coating material to harden.

It is a further object of the invention to provide an apparatus for carrying out the method according to the invention, which apparatus comprises a probe carrying element provided with a plurality of probes, and means for applying coating material.

BRIEF DESCRIPTION OF THE DRAWING

The invention will now be described by way of example in more detail with reference to the drawings, wherein:

FIG. 1 shows a top plan view of the apparatus according to the invention;

FIG. 2 shows a cross-section of a fragment of the apparatus along the line II—II of FIG. 1;

FIGS. 3A, 3B, 3C and 3D show a cross-section of a fragment of the apparatus along the line III—III of FIG. 1 and of a fiber blanket to be coated, illustrating four successive steps of the method according to the invention; and FIG. 4 shows a cross-section of a coated fiber blanket coated by means of the method according to the invention.

DETAILED DESCRIPTION OF THE INVENTION

Figure 3A:
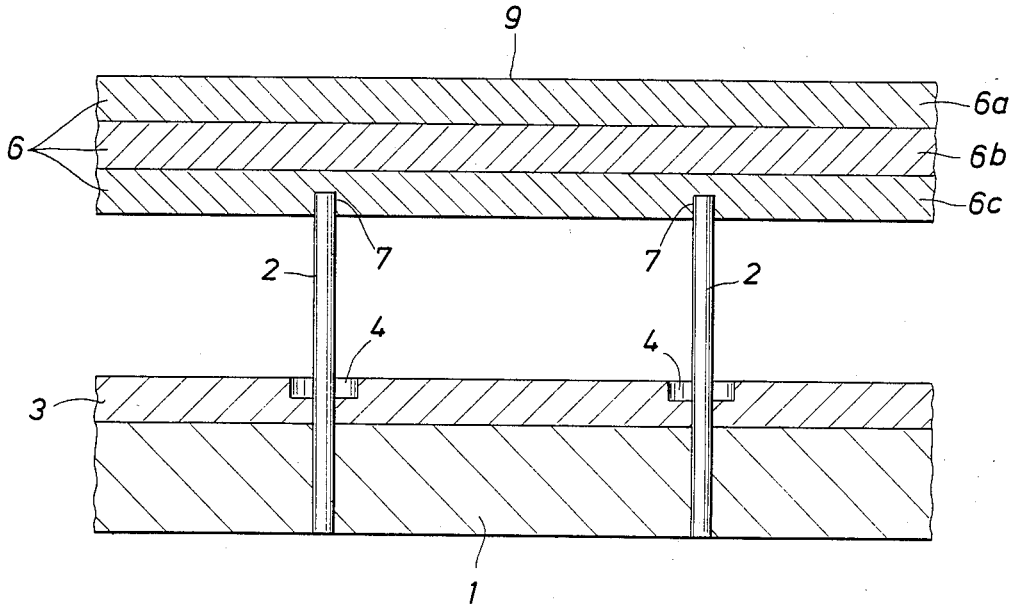
Figure 3B:
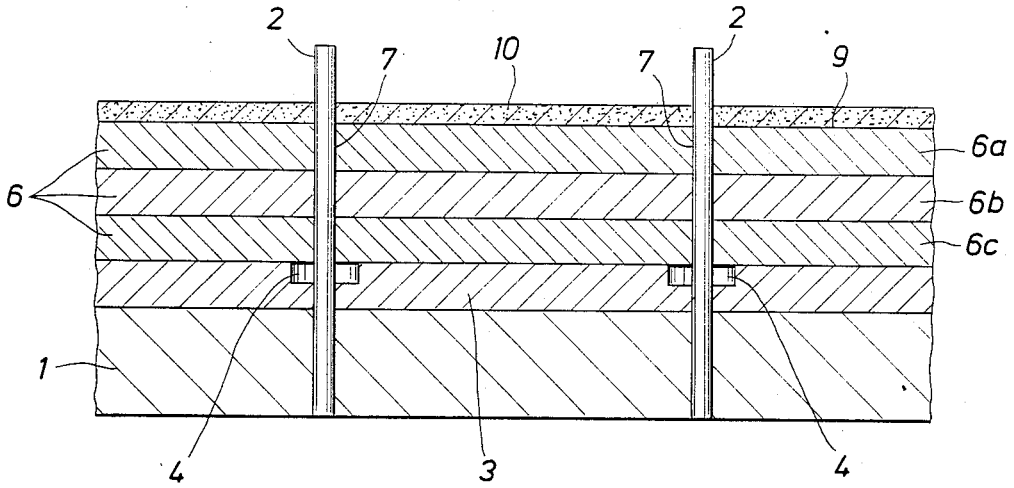

Reference is first made to FIGS. 1 and 2. For the sake of clarity FIG. 2 has been drawn on a scale larger than the scale of FIG. 1. The apparatus comprises a probe carrying element in the form of a flat base plate 1 provided with a plurality of probes 2, and a flat separating plate 3 provided with cups 4. Each cup 4 surrounds a corresponding probe 2 and is bounded at the lower side by a bottom part 5, which fits closely around the corresponding probe 2 so as to allow displacement of the flat separating plate 3 relative to the probes 2.

The method according to the invention will now be described with reference to FIGS. 3A, 3B, 3C and 3D. For the sake of clarity FIGS. 3A, 3B, 3C and 3D have been drawn on a scale larger than the scale of FIG. 1. In these Figures, the fiber blanket is indicated by the reference numeral 6 and comprises three layers *6a*, *6b* and *6c* of ceramic fibers which have been pressed together.

FIG. 3A shows the first step of the method according to the invention, in which the probes 2 are being forced through the fiber blanket 6, so that holes 7 are formed in the fiber blanket 6.

When the probes 2 extend beyond the surface 9 (to be coated) of the fiber blanket 6, a layer 10 (see FIG. 3B) of fluid coating material is applied on the surface 9. Thereupon the fiber blanket 6 is displaced relative to the flat base plate 1 by displacing the flat separating plate 3, so that the probes 2 are retracted from the fiber blanket 6 (see FIG. 3C), until finally the probes 2 have reached the position as shown in FIG. 3D.

During the retraction of the probes 2, the fluid coating material is allowed firstly to flow into the holes 7 and finally into the cups 4 as well.

In the position as shown in FIG. 3D, each probe 2 is just retracted from each cup 4 but is still surrounded by a bottom part 5. During the retraction of the probes 2 the fluid coating material will fill up the holes 7 and the cups 4 completely. In the position as shown in FIG. 3D the coating material present in the holes 7 and the cups 4 is allowed to harden, so that strong studs 8 provided with heads 11 are formed. The heads 11 are located at the uncoated surface 12 of the fiber blanket 6.

When the coating material has hardened completely, the blanket 6 is removed from the plate 3 (see FIG. 4). In the blanket 6 as obtained, the layer of hardened coating material 10 is firmly anchored to the fiber blanket 6 by means of the studs 8 provided with the heads 11. As a result of the presence of the studs 8 with heads 11, the layer 10 of hardened coating material will not easily peel from the fiber blanket 6 when the coated fiber blanket is deformed. In addition thereto, the studs 8 and the heads 11 bond the layers *6a*, *6b* and *6c* of the fiber blanket 6 together and prevent separation of these layers, when the coated fiber blanket is deformed.

In order to facilitate the first step of the method, in which the probes 2 are forced through the fiber blanket 6, use can be made of a flat pushing plate (not shown) provided with holes so arranged that they correspond with the location of the cups in the flat separating plate 3. This pushing plate is placed on the surface 9 to be coated to displace the fiber blanket 6 towards the flat base plate 1. It will be appreciated that the flat pushing plate has to be removed prior to the application of the coating material.

If desired, the coating material may be sprayed on the surface 9 to be coated. Furthermore it is observed that, if desired, the coating material may be applied on the surface 9 to be coated prior to forcing the probes 2 through the fiber blanket 6.

The invention is not restricted to probes having a circular cross-section. Instead they may be fluted and/or may be pointed at the ends.

The invention is not restricted to a fiber blanket comprising three layers of fibers, the method according to the invention may be applied to a fiber blanket having any number of layers of fibers pressed together.

The invention is not restricted to coating a surface of a fiber blanket comprising ceramic fibers; the method may also be applied to coating surfaces of fiber blankets comprising other fiber materials, for example glass-fibers. Moreover the coating material may be any suitable chemical coating material having the property of being able to harden within a reasonable period of time. These coating materials may be based on water or solvent or both.

Suitable coating materials include the thermoplastic resins, thermosetting resins and elastomeric resins. Examples of thermoplastic resins include the polyolefins such as polypropylene, polyethylene, polybutylene, etc. Suitable thermosetting resins include the epoxy resins, polyester resins, vinyl resins, polyurethane resins, etc. Suitable elastomer resins include the block polymers of polyolefins and aromatic monomers such as styrene.

Of course, mixtures of resin may be employed.

Resinous compositions also may include curing agents, catalysts, fillers, thixotropic agents, pigments, stabilizers and the like.

In an attractive embodiment of the invention the apparatus includes a probe carrying element comprising a rotatable cylinder, provided with a plurality of probes extending in radial direction. During application of fluid coating material on the surface of the fiber blanket to be coated, the fiber blanket is passed substantially without slip over the cylinder, causing the probes to be forced through the moving fiber blanket and to be retracted therefrom, and the coating material is allowed to flow into the holes in the fiber blanket. To form heads of coating material at the uncoated surface of the fiber blanket, the apparatus further includes a movable plate or strip provided with cups. The movable plate or strip is positioned in such a way that it is in contact with the uncoated surface of the fiber blanket as the fiber blanket is displaced away from the rotating cylinder. When the holes in the fiber blanket pass over the cups in the movable plate or strip, coating material will flow out of the holes in the fiber blanket into the cups to form heads of coating material at the uncoated surface of the fiber blanket. Thereupon external means cause the movable plate or strip to move with the fiber blanket during a certain period of time so as to allow the coating material to harden and the heads to be formed. When the coating material is sufficiently hard, the movable plate or strip is separated from the fiber blanket, and used to take up the initial place of another movable plate or strip moving with the fiber blanket away from the rotating cylinder.

What is claimed is:

1. Method of coating a surface of a fiber blanket comprising forcing a plurality of probes upwardly through the fiber blanket until the probes extend beyond the surface to be coated, so that holes are formed in the fiber blanket, applying fluid coating material on the surface to be coated, retracting the probes from the fiber blanket, allowing the coating material to flow into the holes during the retraction of the probes, forming heads of the coating material at the uncoated surface of the fiber blanket, and allowing the coating material to harden.

2. Method as claimed in claim 1, comprising spraying the coating material on the surface to be coated.

3. Coated fiber blanket comprising a plurality of layers of fibers tied together by means of the method as claimed in claim 1.

4. A fiber blanket coating apparatus comprising a means for forcing a plurlity of probes upwardly through a fiber blanket, and for retracting said probes and means for applying a fluid coating material on the surface of the fiber blanket to be coated.

* * * * *